US005078618A

United States Patent [19]

Peloza

[11] Patent Number: 5,078,618

[45] Date of Patent: Jan. 7, 1992

[54] ELECTRICAL CONTACT SOCKET

[75] Inventor: Kirk B. Peloza, Wheaton, Ill.

[73] Assignee: Molex Incorporated, Lisle, Ill.

[21] Appl. No.: 664,712

[22] Filed: Mar. 5, 1991

[51] Int. Cl.[5] ..... H01R 4/24

[52] U.S. Cl. ..... 439/439; 439/843

[58] Field of Search ..... 439/438–441, 439/851–857, 842, 843, 849, 850

[56] References Cited

U.S. PATENT DOCUMENTS

| | | | |
|---|---|---|---|
| 3,206,710 | 9/1965 | McLaughlin | 439/441 |
| 3,671,924 | 6/1972 | Nagano | 439/440 |
| 3,786,401 | 1/1974 | Jones et al. | 439/851 |

FOREIGN PATENT DOCUMENTS

| | | | |
|---|---|---|---|
| 1246078 | 8/1967 | Fed. Rep. of Germany | 439/439 |
| 2808671 | 9/1979 | Fed. Rep. of Germany | 439/438 |
| 2918437 | 11/1980 | Fed. Rep. of Germany | 439/438 |
| 3118057 | 11/1982 | Fed. Rep. of Germany | 439/441 |

*Primary Examiner*—David L. Pirlot

*Attorney, Agent, or Firm*—Louis A. Hecht; Stephen Z. Weiss

[57] ABSTRACT

An electrical contact socket is provided with an open end for receiving a pin to form an electrical connection therewith. The socket has walls provided with at least a pair of inwardly projecting resilient tongues extending axially of the socket and having free ends directed away from the open pin-receiving end of the socket. The free ends of the tongues are formed with V-shaped cut-outs for engaging the pin. The included angle of one of the V-shaped cut-outs is different from the included angle of the other V-shaped cut-out to cause binding between the contact socket and the pin in response to relative rotation therebetween.

16 Claims, 2 Drawing Sheets

ELECTRICAL CONTACT SOCKET

FIELD OF THE INVENTION

This invention generally relates to the art of electrical connectors, and, particularly, to an electrical contact socket for receiving a pin to form an electrical connection therewith.

BACKGROUND OF THE INVENTION

Various types of electrical connectors include an electrical contact socket having an open end for receiving a pin, such as a terminal pin, to form an electrical connection between the socket and the pin. One type of contact socket commonly has been termed a wire-trap socket, wherein a wire or a pin easily is inserted into the socket but is difficult to be removed therefrom.

For instance, a wire-trap electrical contact socket may have a plurality of inwardly projecting resilient tongues extending axially of the socket with free ends of the tongues directed away from the open pin-receiving end of the socket. Therefore, a pin easily can be inserted into the socket, simply by deflecting the tongues away from the open end of the socket, i.e., in the insertion direction of the pin. If an attempt is made to pull the pin out of the socket, the free ends of the tongues resist such removal. Commonly, if it is necessary to remove a pin from such a socket, removal is facilitated by twisting or rotating the pin in a sort of screw fashion. In fact, the tongues might score the outside of the pin in a spiral fashion. If the pin cannot be rotated sufficiently, removal can be facilitated by twisting the pin back and forth while pulling on the pin.

However, there are certain environments wherein electrical contact sockets of the character described above have proven deficient because the pin is capable of working its way out of the socket. Such environments normally involve vibrations of the electrical connection. For instance, the pin might be a component of an appliance, such as a pin of a heating element in a dishwasher, wherein the electrical connection between the pin and the socket constantly is exposed to vibrations. Effectively, the pin works its way out of the socket, similar to the above-described action of twisting or rotating the pin back and forth, in response to the vibrations.

This invention is directed to solving the above problems by providing an electrical contact socket which prevents a pin from backing out of its socket even under conditions of vibration by preventing unintentional rotation of the pin relative to the socket.

SUMMARY OF THE INVENTION

An object, therefore, of the invention is to provide a new and improved electrical contact socket having an open end for receiving a pin to form an electrical connection therewith.

Generally, the invention contemplates an electrical contact socket which has wall means provided with at least a pair of inwardly projecting resilient tongues extending axially of the socket and having free ends directed away from the open pin-receiving end of the socket. In the preferred embodiment, the free ends of the tongues are formed with V-shaped cut-outs for engaging the pin. The included angle of one of the V-shaped cut-outs is different from the included angle of the other V-shaped cut-out. In this manner, the differential angles of the cut-out portions of the free ends of the tongues cannot act as a screw-thread means even under severe vibrations of the socket and pin.

In the exemplary embodiment of the invention, two pairs of inwardly projecting resilient tongues are provided at axially spaced locations within the socket. The tongues of each pair generally are diametrically disposed across the socket to grip the pin therebetween. The included angles of the cut-outs in the free ends of one pair of tongues are different from the included angles of the cut-outs in the free ends of the other pair of tongues.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
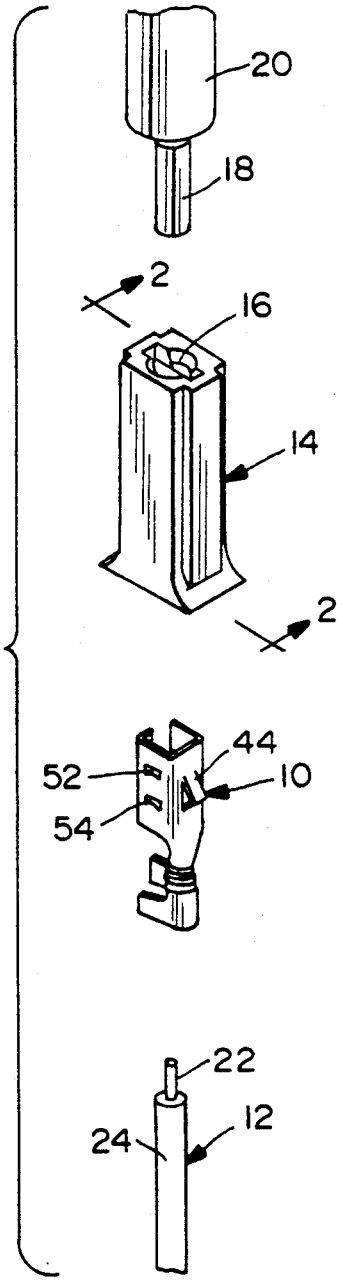
FIG. 1 is an exploded perspective view of the components of an electrical connection system including the electrical contact socket of the invention.

Referring to the drawings in greater detail, and first to FIG. 1, the invention is embodied in a terminal or electrical contact socket, generally designated 10, for terminating an insulating wire generally designated 12. The socket is inserted into a housing, generally designated 14. The housing has an opening 16 for receiving a pin 18 of an electrical component 20. Insulated wire 12 has a conductive core 22 surrounded by an insulating jacket 24.

Before proceeding further, it should be understood that electrical contact socket 10 is shown herein for receiving pin 18 of an electrical component 20 such as a heating element in a dishwasher or other appliance which is subjected to a high vibration environment. However, it should be understood that the concepts of the invention are equally applicable for any type of electrical connector system wherein it is desirable to prevent practically any unintentional removal of a pin-type terminal component from a socket-type contact or terminal.

Figure 2:
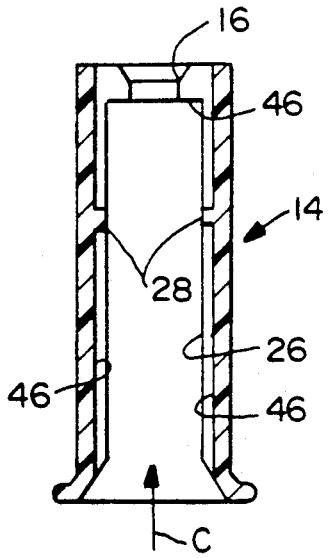
FIG. 2 is a vertical section through the connector housing, taken generally along line 2—2 of FIG. 1.

FIG. 2 is an axial section through housing 14 simply to show that the housing has an interior cavity 26 of a generally rectangular configuration for receiving contact socket 10. The housing is unitarily molded of dielectric material, such as plastic or the like, and includes inwardly directed projections 28 intermediate the ends of cavity 26, for purposes described hereinafter.

FIGS. 3–8 show details of contact socket 10 which incorporates the concepts of the invention. In a known fashion, the socket includes two pairs of crimp arms 30 and 32, respectively, for clamping onto insulated wire 12 and terminating the core of the wire. To this end, preferably, contact socket 10 is unitarily fabricated of stamped and formed metal material.

Figure 3:
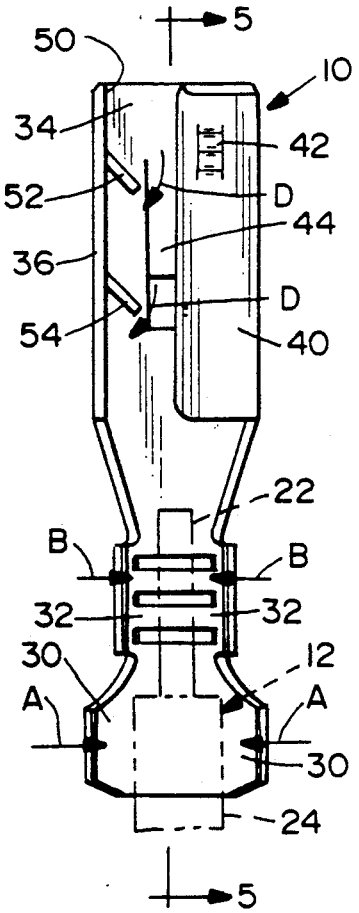
FIG. 3 is a side elevational view of the electrical contact socket of the invention.

Specifically, in assembly, referring to FIG. 3, crimp arms 30 are deformed inwardly in the direction of arrows "A" to clamp onto insulating jacket 24 of insulated wire 12 to provide a strain relief on the wire. Crimp arms 32 are deformed inwardly in the direction of arrows "B" to clamp onto an exposed portion of conductive core 22 to electrically terminate contact socket 10 to the core which has been stripped of insulating jacket 24.

Figure 4:
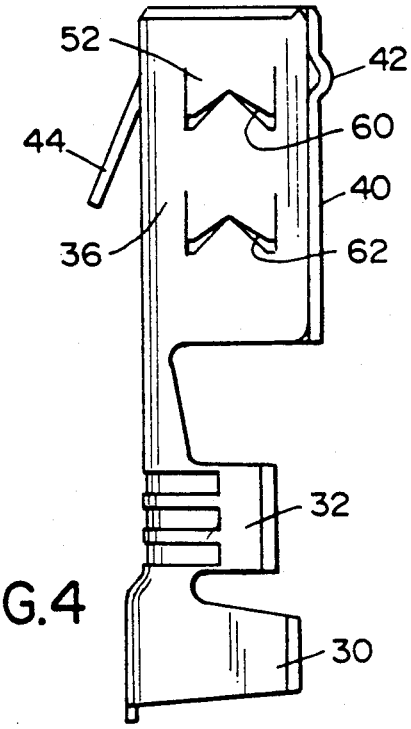
FIG. 4 is a side elevational view of the socket, looking toward the left-hand side of the socket in FIG. 3.
Figure 5:
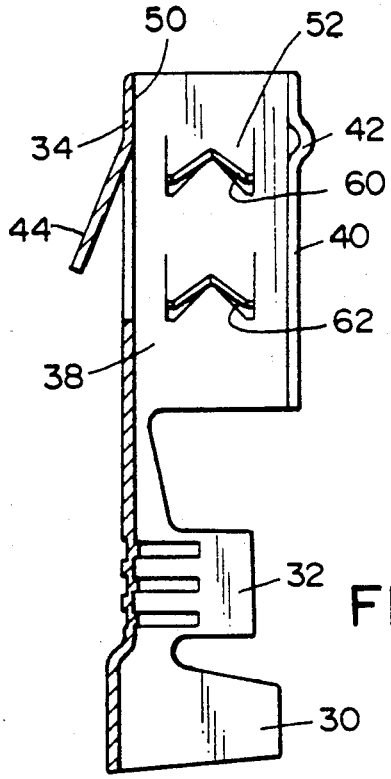
FIG. 5 is a vertical section taken generally along line 5—5 of FIG. 3.

The remainder of contact socket 10 is formed with wall means including a bottom wall 34 joined to a pair of side walls 36 and 38, side wall 38 being joined to a partial top wall 40. As best seen in FIGS. 4 and 5, a detent in the form of an outwardly projecting dimple 42 is formed in partial top wall 40, and an outwardly projecting locking tongue 44 is stamped and formed out of bottom wall 34.

Referring back to FIG. 2 in conjunction with FIGS. 4 and 5, in assembly, contact socket 10 is inserted into housing 14 in the direction of arrow "C" (FIG. 2). During insertion, detent 42 first snaps over one of the inwardly directed projections 28 within cavity 26 of the housing. Further insertion causes locking tongue 44 to snap behind the opposite projection. The detent and the locking tongue ride in grooves 46 in the cavity 26. When fully inserted, the front end of the socket abuts against a forward shoulder 46 at the end of cavity 26 and locking tongue 44 snaps behind its respective projection 28. In fully assembled condition, the contact socket is stabilized within housing 14 by projections 28 engaging bottom wall 34 and partial top wall 40 of the socket, with detent 42 and locking tongue 44 disposed within grooves 46 which run longitudinally of cavity 26.

Wall means 34, 36, 38 and 40 of contact socket 10 define an open end 50 into which pin 18 (FIG. 1) is freely insertable. Generally, the pin is locked within the contact socket against removal therefrom by a plurality of inwardly projecting resilient tongues which extend axially of the socket, the tongues having free ends directed away from open pin-receiving end 50. This is seen by the position of pin 18 in FIG. 6.

Figure 6:
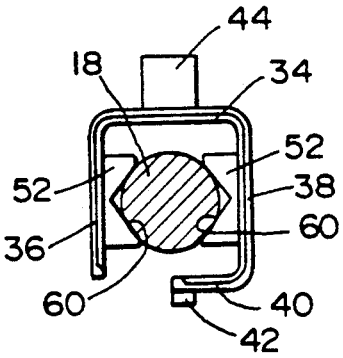
FIG. 6 is a top plan view of the contact socket of FIG. 3.

More particularly, in the exemplary embodiment of the invention, two pairs of inwardly projecting resilient tongues are provided. One pair includes tongues 52 which are closest to open end 50, and the other pair includes tongues 54 which are disposed axially inwardly of tongues 52. The tongues of each pair are stamped and formed out of side walls 36 and 38 of the contact socket, as best seen in FIGS. 4 and 5, whereby the tongues of each pair are generally diametrically disposed across the socket, as best seen in FIG. 6.

As best seen in FIG. 3, the tongues extend axially of the socket in a direction to present free ends thereof directed away from open pin-receiving end 50 of the socket. Therefore, when a pin is inserted into the open end, the tongues deflect in the direction of arrows "D" (FIG. 3) to allow for substantially force-free insertion of the pin into the socket. However, if it is attempted to remove the pin from the socket, the tongues grip the pin to resist its removal. The free ends of tongues 52 are formed with notches in the form of V-shaped cut-outs 60, and the free ends of tongues 54 are formed with notches in the form of V-shaped cut-outs 62. The V-shaped cut-outs of all of the tongues grip pin 18, as shown by the V-shaped cut-outs 60 of tongues 52 in FIG. 6.

Figure 8:
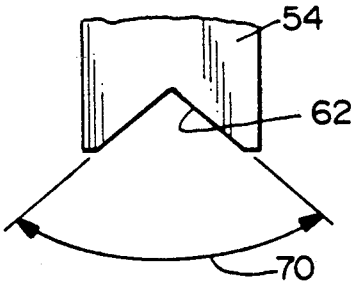
FIG. 8 is a view similar to that of FIG. 7, illustrating one of the tongues of the other pair thereof.
Figure 7:
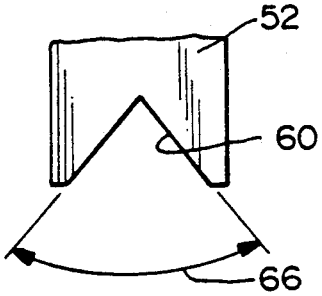
FIG. 7 is a fragmented elevational view of one of the tongues in one of the pairs thereof.

Referring to FIGS. 7 and 8, one of each of the pairs of tongues 52 and 54 are shown in those figures, respectively, in a straight plan depiction, as if looking in a direction perpendicular to the tongues. The V-shaped cut-out 60 in each tongue 52 is defined by an included angle as indicated by double-headed arrow 66. Likewise, the V-shape cut-out 62 in the free end of each tongue 54 is defined by an included angle as indicated by double-headed arrow 70. The invention contemplates that the included angle of one of the tongues be different from the included angle of the other tongue. For instance, angle 66 of V-shaped cut-out 60 of tongue 52 may be on the order of 80°, and angle 70 of the V-shaped cut-out 62 of tongue 54 may be on the order of 100°. The result of the differential angled cut-outs is that a "binding" effect is created should pin 18 be rotated relative to contact socket 10.

In other words, as described in the "Background", above, although conventional wire-trap contact sockets are designed to provide a high removal force against an inserted pin should an attempt be made simply to pull the pin axially out of the socket, removal of the pin can be facilitated by rotating the pin in a screw fashion or by rotating or twisting the pin back and forth in conjunction with a pulling force. With this understanding, it can be appreciated that if such a pin and socket arrangement is used in a high vibration environment, such as in appliances as might be encountered in terminating a heating element pin in a dishwasher, the pin might work itself out of the socket by vibratory back and forth twisting motions. With the invention, by varying the included angles of the V-shaped cut-outs in the free ends of at least two of the tongues, a binding affect is created. The action is sort of like attempting to rotate a bolt having threads of one pitch into a nut having threads of a different pitch. The more the bolt is rotated, the tighter becomes the binding affect. Likewise, the differential included angles in the V-shaped cut-outs oppose each other and increase the opposition when the cut-outs begin to score the periphery of the terminal pin.

Although the invention is shown herein by a particular arrangement of two pairs of tongues 52 and 54, with the V-shaped cut-outs of the tongues of each pair having the same included angle, it can be appreciated that other combinations are contemplated by the invention. For instance, the V-shaped cut-outs of one tongue of each pair may have an included angle different from that of the other tongue of each pair. In addition, two pairs of tongues may not necessarily be required. The two pairs of tongues provide considerable stability for grasping the terminal pin. On the other hand, a single pair of tongues, either diametrically or axially spaced of the pin still will create a binding affect if the tongues have differential angled cut-outs, particularly as the cut-outs score into the terminal pin. Still further, the invention might be considered as engaging the pin by different angled edges on the free ends of two distinct resilient tongues.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical contact socket having an open end for receiving a pin to form an electrical connection therewith, comprising wall means provided with at least a pair of inwardly projecting resilient tongues extending axially of the socket and having free ends directed away from the open pin-receiving end of the socket, the free ends of the tongues being formed with V-shaped cut-outs for engaging the pin, the included angle of one of the V-shaped cut-outs being different from the included angle of the other V-shaped cut-out.

2. The electrical contact socket of claim 1 wherein said tongues are spaced axially of the socket.

3. The electrical contact socket of claim 1 wherein said socket comprises a stamped and formed metal component.

4. The electrical contact socket of claim 1 wherein one of said tongues is disposed on a side of the socket opposite the other tongue.

5. The electrical contact socket of claim 1, including two pairs of said tongues, one pair being spaced axially of the socket relative to the other pair, and the tongues in each pair having V-shaped cut-outs of the same included angle but different from that of the tongues of the other pair.

6. The electrical contact socket of claim 5 wherein the tongues in each pair are diametrically disposed on opposite sides of the socket.

7. An electrical contact socket having an open end for receiving a pin to form an electrical connection therewith, comprising wall means with at least a pair of diametrically disposed inwardly projecting resilient tongues and at least one additional inwardly projecting resilient tongue axially spaced from said pair, the tongues extending axially of the socket and having free ends directed away from the open pin-receiving end of the socket, the free ends of the tongues being formed with V-shaped cut-outs for engaging the pin, the included angle of the V-shaped cut-out in the free end of at least one of the tongues being different from the included angle in the free end of the V-shaped cut-out of at least one other tongue.

8. The electrical contact socket of claim 7 wherein said socket comprises a stamped and formed metal component.

9. A unitary electrical contact socket fabricated of stamped and formed metal material and having an open end for receiving a pin to form an electrical connection therewith, comprising wall means provided with two pairs of inwardly projecting resilient tongues extending axially of the socket and having free ends directed away from the open pin-receiving end of the socket, one pair of tongues being spaced axially of the socket relative to the other pair of tongues, the tongues in each pair thereof being diametrically disposed on opposite sides of the socket, the free ends of the tongues being formed with V-shaped cut-outs for engaging the pin, and the included angle of the V-shaped cut-outs in the free ends of one pair of tongues being different from the included angle of the V-shaped cut-outs in the free ends of the other pair of tongues.

10. An electrical connector system, comprising:

a terminal pin; and an electrical contact socket having an open end for receiving the pin to form an electrical connection therewith, the contact socket including wall means provided with at least a pair of inwardly projecting resilient tongues extending axially of the socket and having free ends directed away from the open pin-receiving end of the socket, the free ends of the tongues being formed with V-shaped cut-outs for engaging the pin, the included angle of one of the V-shaped cut-outs being different from the included angle of the other V-shaped cut-out.

11. The electrical connector system of claim 10 wherein said tongues are spaced axially of the socket.

12. The electrical connector system of claim 10 wherein said socket comprises a stamped and formed metal component.

13. The electrical connector system of claim 10 wherein one of said tongues is disposed on a side of the socket opposite the other tongue.

14. The electrical connector system of claim 10, including a heating element, with said terminal pin forming a portion of the heating element.

15. The electrical connector system of claim 10, including two pairs of said tongues, one pair being spaced axially of the socket relative to the other pair, and the tongues in each pair having V-shaped cut-outs of the same included angle but different from that of the tongues of the other pair.

16. The electrical connector system of claim 15 wherein the tongues in each pair are diametrically disposed on opposite sides of the socket.

* * * * *